US008152252B2

(12) United States Patent
Liang et al.

(10) Patent No.: US 8,152,252 B2
(45) Date of Patent: Apr. 10, 2012

(54) SLIDE ASSEMBLY

(75) Inventors: Hsiu-Chiang Liang, Kaohsiung Hsien (TW); Ken-Ching Chen, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 291 days.

(21) Appl. No.: 12/382,452

(22) Filed: Mar. 17, 2009

(65) Prior Publication Data

US 2009/0238503 A1 Sep. 24, 2009

(30) Foreign Application Priority Data

Mar. 21, 2008 (TW) ..... 97110278 A

(51) Int. Cl.
*A47B 88/00* (2006.01)

(52) U.S. Cl. ..... 312/334.6; 312/334.9

(58) Field of Classification Search ..... 312/334.37–334.46, 333, 334.6, 312/334.9, 334.11, 334.12, 334.13, 334.15, 312/334.17, 334.18, 334.25, 334.26, 334.33, 312/334.27; 384/20; 248/430
See application file for complete search history.

(56) References Cited

U.S. PATENT DOCUMENTS

| | | | | |
|---|---|---|---|---|
| 5,769,518 | A * | 6/1998 | Grabher | 312/334.6 |
| 6,386,499 | B1 * | 5/2002 | Okazaki et al. | 248/430 |
| 6,682,160 | B2 | 1/2004 | Kung | |
| 6,854,817 | B1 | 2/2005 | Simon | |
| 7,866,772 | B1 * | 1/2011 | Chen | 312/334.9 |
| 2005/0231083 | A1 * | 10/2005 | Garcie | 312/333 |
| 2008/0284299 | A1 | 11/2008 | Chen et al. | |

FOREIGN PATENT DOCUMENTS

DE 4312425 A1 * 10/1994

* cited by examiner

*Primary Examiner* — Korie Chan
(74) *Attorney, Agent, or Firm* — Rosenberg, Klein & Lee

(57) ABSTRACT

A slide assembly includes a bracket, having a first horizontal portion and a first vertical portion; a first rail member slidably disposed on the bracket, having a first horizontal portion, a first vertical portion, a second horizontal portion, and a second vertical portion; a second rail member slidably disposed on the first rail member, having a first vertical portion, a first horizontal portion and a second vertical portion; a first auxiliary sliding member disposed between the bracket and the first rail member; a second auxiliary sliding member disposed between the first rail member and the second rail member; and a plurality of ball bearings including at least one first ball bearing and at least one second roller bearing.

7 Claims, 5 Drawing Sheets

SLIDE ASSEMBLY

BACKGROUND OF THE INVENTION

1. Field of the Invention

The present invention relates to a slide assembly, and more particular to an undermount slide assembly applied to a drawer of a closet and the like.

2. Description of the Prior Art

A slide assembly has been disclosed, such as U.S. Pat. No. 6,682,160 to Kung, titled "Drawer sliding structure", and U.S. Pat. No. 6,854,817 to Simon, titled "Undermount drawer slide".

U.S. Pat. No. 6,682,160 to Kung disclosed an undermount drawer sliding structure including a vertical roller 51 disposed between an outer rail 20 and an inner rail 30. The vertical roller 51 provides left and right rolling support to the outer rail 20 and the inner rail 30. The outer rail 20 is generally coupled to the bottom of a drawer. When the drawer and the outer rail are pulled outwardly in a suspending status, the outer rail will provide a vertical weight and have its end lifting upwardly due to weight unbalance. The vertical roller 51 doesn't provide an applied force against the outer rail lifting upwardly. It is necessary to provide a support mechanism having a sliding effect between the outer rail 20 and the inner rail 30.

U.S. Pat. No. 6,854,817 to Simon also disclosed an undermount drawer slide. The drawer slide includes a cabinet rail 11 with a flange to slide horizontally with respect to bearings 83*a*, 83*b* in a middle rail 13. When the drawer is pulled, the drawer will shake and produce noise. In addition, the cabinet rail is provided with a horizontal offset flange 75 which doesn't have a better rigidity to bear its whole weigh.

The prior art doesn't solve the problems of stability, noise, simple structure.

SUMMARY OF THE INVENTION

The primary objective of the present invention is to provide a slide assembly applied to the drawer of a closet for providing a stable support.

According to the present invention, there is provided a slide assembly, comprising:

a bracket comprising a first horizontal portion, a first vertical portion, and a second horizontal portion, the first horizontal portion having a first end, the first vertical portion having a first end and a second end extending from the first end of the first horizontal portion, the second horizontal portion having a first end and a second end extending from the first end of the first vertical portion;

a first rail member slidably disposed on the bracket, the first rail member comprising a first horizontal portion, a first vertical portion, a second horizontal portion, and a second vertical portion, the first horizontal portion having a first end, the first vertical portion having a first end and a second end extending from the first end of the first horizontal portion, the second horizontal portion having a first end and a second end extending from the first end of the first vertical portion, the second vertical portion having a first end and a second end extending from the first end of the second horizontal portion;

a second rail member slidably disposed on the first rail member, the second rail member comprising a first vertical portion, a first horizontal portion, and a second vertical portion, the first vertical portion having a first end and a second end, the first horizontal portion having a first end and a second end extending from the first end of the first vertical portion, the second vertical portion having a first end and a second end extending from the first end of the first horizontal portion;

a first auxiliary sliding member disposed between the bracket and the first rail member, the first auxiliary sliding member comprising a first seat, at least one first roller bearing, at least one second roller bearing, at least one third roller bearing, and at least one fourth roller bearing, the first roller bearing being disposed between the first vertical portion of the bracket and the second vertical portion of the first rail member for providing a rolling contact, the second roller bearing being disposed between the first vertical portion of the bracket and the first vertical portion of the first rail member for providing the rolling contact, the third roller bearing being disposed between the first horizontal portion of the bracket and the second horizontal portion of the first rail member for providing the rolling contact, the fourth roller bearing being disposed between the first horizontal portion of the bracket and the first horizontal portion of the first rail member for providing the rolling contact;

a second auxiliary sliding member disposed between the first rail member and the second rail member, the second auxiliary sliding member comprising a first seat and at least one first roller bearing, the first roller bearing being disposed between the second horizontal portion of the first rail member and the first horizontal portion of the second rail member for providing the rolling contact; and a plurality of ball bearings including at least one first ball bearing and at least one second ball bearing, the first ball bearing being disposed between the first vertical portion of the first rail member and the first vertical portion of the second rail member for providing a free rolling direction contact, the second ball bearing being disposed between the second vertical portion of the first rail member and the second vertical portion of the second rail member for providing the free rolling direction contact.

Preferably, a first bearing raceway is formed between the first vertical portion of the first rail member and the first vertical portion of the second rail member for the first ball bearing to seat and to slide therealong.

Preferably, a second bearing raceway is formed between the second vertical portion of the first rail member and the second vertical portion of the second rail member for the second ball bearing to seat and to slide therealong.

Preferably, the first seat of the second auxiliary member is provided with a plurality of holding members relative to the ball bearings for holding the ball bearings in a preset position.

DETAILED DESCRIPTION OF THE PREFERRED EMBODIMENTS

Figure 1:
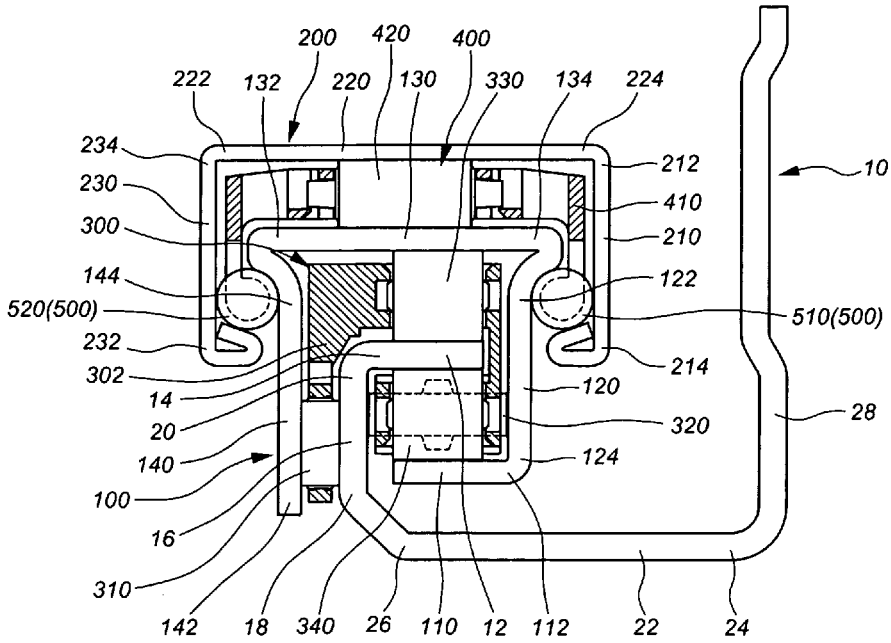
FIG. 1 is a cross-sectional view of a slide assembly according to a preferred embodiment of the present invention.

As shown in FIG. 1, a slide assembly according to a preferred embodiment of the present invention comprises a bracket 10, a first rail member 100, a second rail member 200, a first auxiliary sliding member 300, a second auxiliary sliding member 400, and a plurality of ball bearings 500.

The bracket 10 comprises a first horizontal portion 12, a first vertical portion 16, a second horizontal portion 22, and a second vertical portion 28. The first horizontal portion 12 has a first end 14. The first vertical portion 16 has a first end 18 and a second end 20 extending from the first end 14 of the first horizontal portion 12. The second horizontal portion 22 has a first end 24 and a second end 26 extending from the first end 18 of the first vertical portion 16. The second vertical portion 28 extends from the first end 24 of the second horizontal portion 22.

The first rail member 100 is slidably disposed on the bracket 10, and comprises a first horizontal portion 110, a first vertical portion 120, a second horizontal portion 130, and a second vertical portion 140. The first horizontal portion 110 has a first end 112. The first vertical portion 120 has a first end 122 and a second end 124 extending from the first end 112 of the first horizontal portion 110. The second horizontal portion 130 has a first end 132 and a second end 134 extending from the first end 122 of the first vertical portion 120. The second vertical portion 140 has a first end 142 and a second end 144 extending from the first end 132 of the second horizontal portion 130.

The second rail member 200 is slidably disposed on the first rail member 100, and comprises a first vertical portion 210, a first horizontal portion 220, and a second vertical portion 230. The first vertical portion 210 has a first end 212 and a second end 214. The first horizontal portion 220 has a first end 222 and a second end 224 extending from the first end 212 of the first vertical portion 210. The second vertical portion 230 has a first end 232 and a second end 234 extending from the first end 222 of the first horizontal portion 220.

The first auxiliary sliding member 300 is disposed between the bracket 10 and the first rail member 100, and comprises a first seat 302, at least one first roller bearing 310, at least one second roller bearing 320, at least one third roller bearing 330, and at least one fourth roller bearing 340. The first roller bearing 310 is disposed between the first vertical portion 16 of the bracket 10 and the second vertical portion 140 of the first rail member 100 for providing a first rolling direction contact. The second roller bearing 320 is disposed between the first vertical portion 16 of the bracket 10 and the first vertical portion 120 of the first rail member 100 for providing the same first rolling direction contact. The third roller bearing 330 is disposed between the first horizontal portion 12 of the bracket 10 and the second horizontal portion 130 of the first rail member 100 for providing a second rolling direction contact. The fourth roller bearing 340 is disposed between the first horizontal portion 12 of the bracket 10 and the first horizontal portion 110 of the first rail member 100 for providing the same second rolling direction contact.

The second auxiliary sliding member 400 is disposed between the first rail member 100 and the second rail member 200, and comprises a first seat 410, and at least one first roller bearing 420. The first roller bearing 420 is disposed between the second horizontal portion 130 of the first rail member 100 and the first horizontal portion 220 of the second rail member 200 for providing the same second rolling direction contact.

The plurality of ball bearings 500 includes at least one first ball bearing 510 and at least one second ball bearing 520. The first ball bearing 510 is disposed between the first vertical portion 120 of the first rail member 100 and the first vertical portion 210 of the second rail member 200 for providing a free rolling direction contact. The second ball bearing 520 is disposed between the second vertical portion 140 of the first rail member 100 and the second vertical portion 230 of the second rail member 200 for providing the free rolling direction contact.

Figure 2:
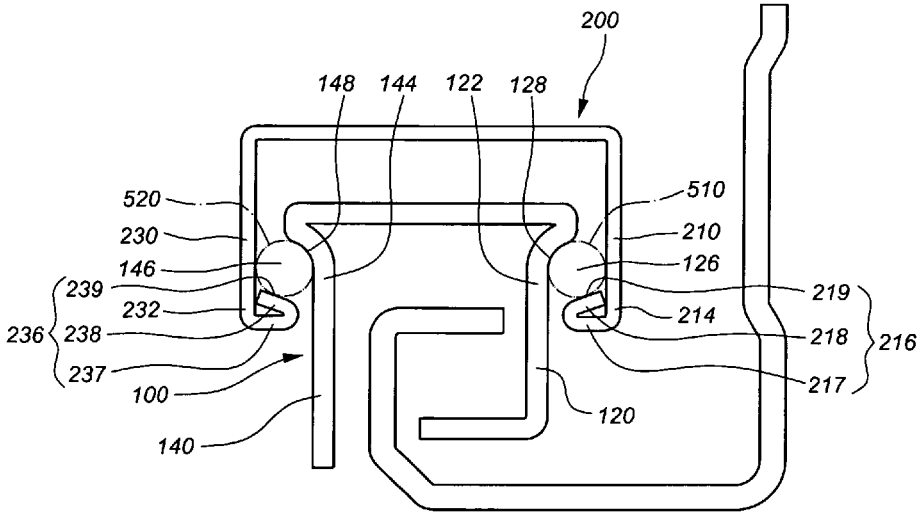
FIG. 2 is a cross-sectional view the slide assembly without a first auxiliary sliding member and a second auxiliary sliding member according to the preferred embodiment of the present invention.

Referring to FIG. 2, a first bearing raceway 126 is formed between the first vertical portion 120 of the first rail member 100 and the first vertical portion 210 of the second rail member 200 for providing a relative raceway to the first ball bearing 510 to ensure a better rolling and support. In this embodiment, the first bearing raceway 126 is formed between a first contact surface 128 provided at the first end 122 of the first vertical portion 120 of the first rail member 100 in relation to the first ball bearing 510, and a first holding portion 216 provided at the second end 214 of the first vertical portion 210 of the second rail member 200 in relation to the first ball bearing 510. The first holding portion 216 extends from the second end 214 of the first vertical portion 210 of the second rail member 200, and comprises a first supporting segment 217 and a second supporting segment 218 extending and bending from the first supporting segment 217. The second supporting segment 218 has a holding surface 219 for holding the first ball bearing 510.

A second bearing raceway 146 is formed between the second vertical portion 140 of the first rail member 100 and the second vertical portion 230 of the second rail member 200 for providing a relative raceway to the second ball bearing 520 to ensure a better rolling and support. In this embodiment, the second bearing raceway 146 is formed between a second contact surface 148 provided at the second end 144 of the second vertical portion 140 of the first rail member 100 in relation to the second ball bearing 520, and a second holding portion 236 provided at the first end 232 of the second vertical portion 230 of the second rail member 200 in relation to the second ball bearing 520. The second holding portion 236 extends from the first end 232 of the second vertical portion 230 of the second rail member 200, and comprises a first supporting segment 237 and a second supporting segment 238 extending and bending from the first supporting segment 237. The second supporting segment 238 has a holding surface 239 for holding the second ball bearing 520.

Figure 3:
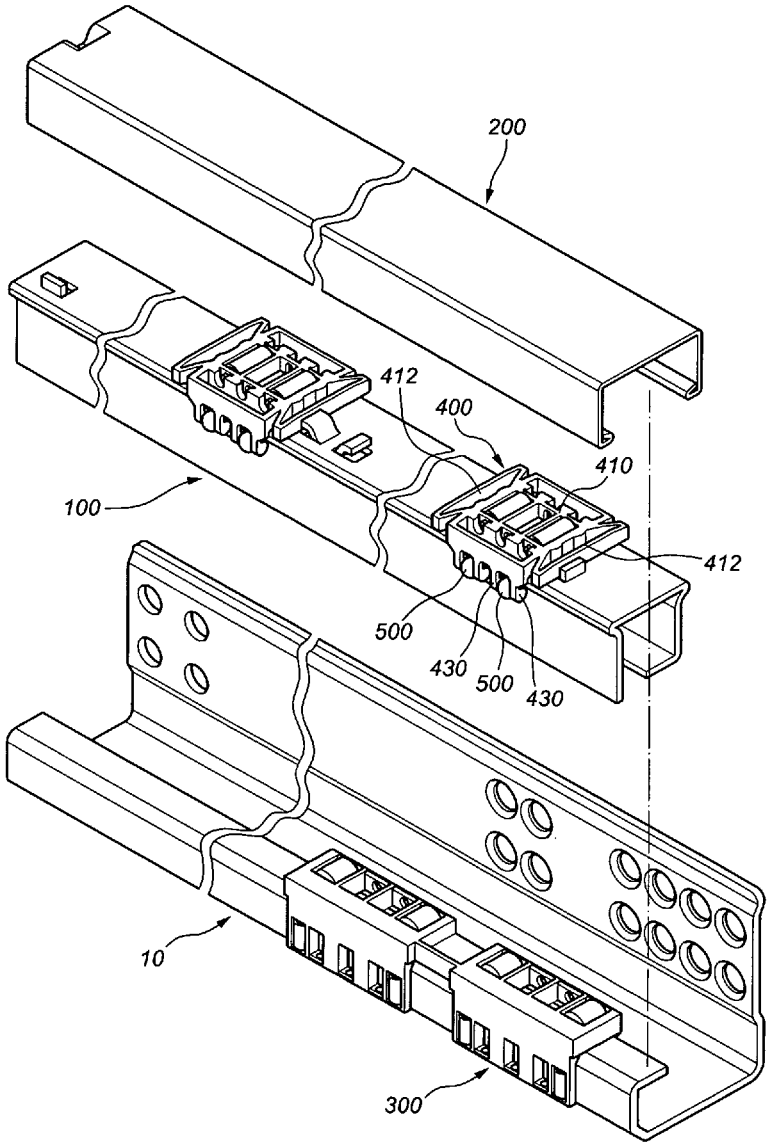
FIG. 3 is an exploded view of the slide assembly according to the preferred embodiment of the present invention.

Referring to FIG. 3, the first seat 410 of the second auxiliary sliding member 400 further comprises a plurality of holding members 430 corresponding in position to the plurality of ball bearings 500 for holding the plurality of ball bearings 500 in a preset position. In addition, the first seat 410 further comprises a buffer 412 to ease the striking force during the operation of the slide assembly. In this embodiment, the buffer 412 is in the form of a closed ring.

Figure 4:
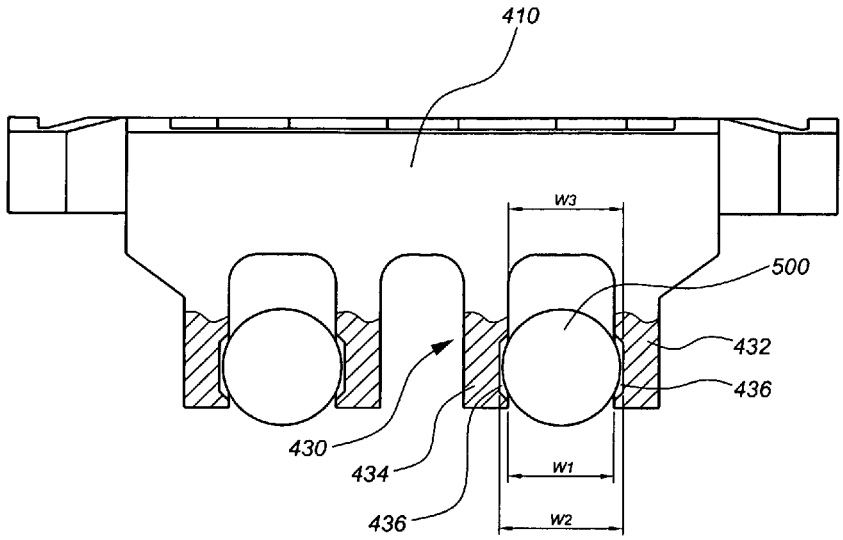
FIG. 4 is a schematic view of ball bearings and holding members according to the preferred embodiment of the present invention.

Referring to FIG. 4, the plurality of holding members 430 of the first seat 410 includes a first holding member 432 and a second holding member 434. A relative ball bearing 500 is disposed between the first holding member 432 and the second holding member 434. A first width W1 is defined between relative inner sides of the first holding member 432 and the second holding member 434. The inner sides of the first holding member 432 and the second holding member 434 are formed with a bearing groove 436, respectively, in relation to the ball bearing 500. A second width W2 is defined between the bearing groove 436 of the first holding member 432 and the bearing groove 436 of the second holding member 434. A third width W3 is defined between the bearing groove 436 of the first holding member 432 and the inner side of the second holding member 434. The ball bearing 500 has a diameter larger than the first width W1 and smaller than the second width W2 or the third width W3. Therefore, only one of the first holding member 432 and the second holding member 434 is formed with the bearing groove 436 to form a clip portion between the first holding member 432 and the second holding member 434 for holding the ball bearing 500 in place without falling.

Figure 5:
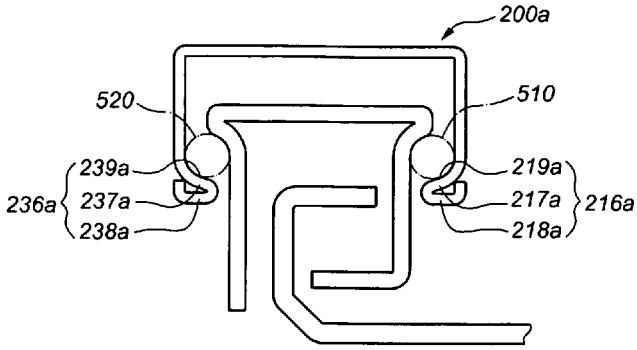
FIG. 5 is a cross-sectional view showing a first different type of the second rail member according to the preferred embodiment of the present invention.

FIG. 5 shows a first different type of the second rail member according to the preferred embodiment of the present invention. A first holding portion 216*a* of a second rail member 200*a* comprises a first supporting segment 217*a* and a second supporting segment 218*a* extending and bending from the first supporting segment 217*a*. The first supporting segment 217*a* has a holding surface 219*a* to support the first ball bearing 510 thereon. A second holding portion 236*a* of the second rail member 200*a* comprises a first supporting segment 237*a* and a second supporting segment 238*a* extending and bending from the first supporting segment 237*a*. The first supporting segment 237*a* has a holding surface 239*a* to support the second ball bearing 520 thereon.

Figure 6:
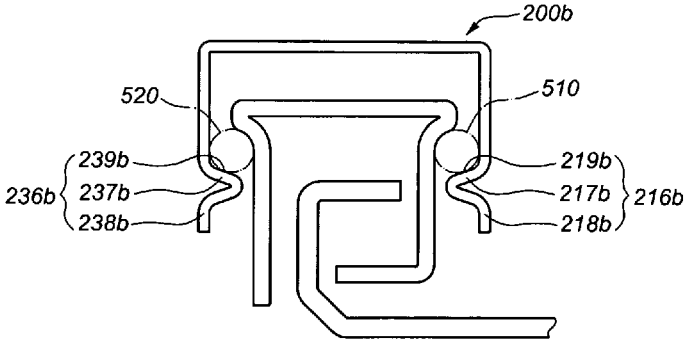
FIG. 6 is a cross-sectional view showing a second different type of the second rail member according to the preferred embodiment of the present invention.

FIG. 6 shows a second different type of the second rail member according to the preferred embodiment of the present invention. A first holding portion 216*b* of a second rail member 200*b* comprises a first supporting segment 217*b* and a second supporting segment 218*b* extending and bending from the first supporting segment 217*b*. The first supporting segment 217*b* has a holding surface 219*b* to support the first ball bearing 510 thereon. A second holding portion 236*b* of the second rail member 200*b* comprises a first supporting segment 237*b* and a second supporting segment 238*b* extending and bending from the first supporting segment 237*b*. The first supporting segment 237*b* has a holding surface 239*b* to support the second ball bearing 520 thereon.

Figure 7:
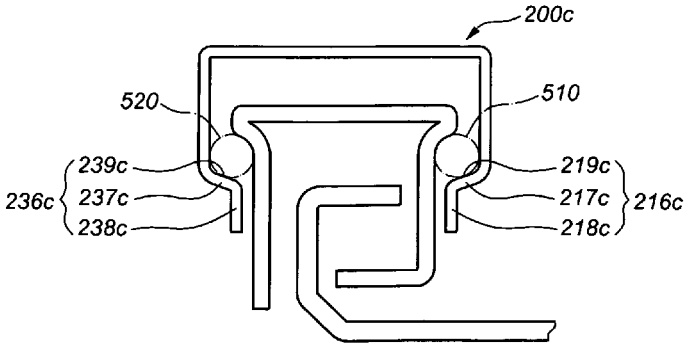
FIG. 7 is a cross-sectional view showing a third different type of the second rail member according to the preferred embodiment of the present invention.

FIG. 7 shows a third different type of the second rail member according to the preferred embodiment of the present invention. A first holding portion 216*c* of a second rail member 200*c* comprises a first supporting segment 217*c* and a second supporting segment 218*c* extending and bending from the first supporting segment 217*c*. The first supporting segment 217*c* has a holding surface 219*c* to support the first ball bearing 510 thereon. A second holding portion 236*c* of the second rail member 200*c* comprises a first supporting segment 237*c* and a second supporting segment 238*c* extending and bending from the first supporting segment 237*c*. The first supporting segment 237*c* has a holding surface 239*c* to support the second ball bearing 520 thereon.

Figure 8:
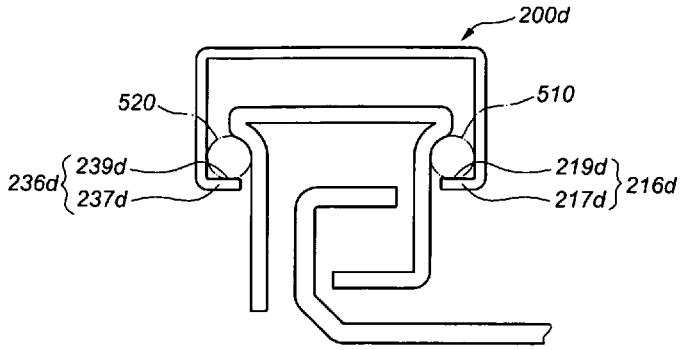
FIG. 8 is a cross-sectional view showing a fourth different type of the second rail member according to the preferred embodiment of the present invention.

FIG. 8 shows a fourth different type of the second rail member according to the preferred embodiment of the present invention. A first holding portion 216*d* of a second rail member 200*d* comprises a first supporting segment 217*d*. The first supporting segment 217*d* has a flat holding surface 219*d* to support the first ball bearing 510 thereon. A second holding portion 236*d* of the second rail member 200*d* comprises a first supporting segment 237*d*. The first supporting segment 237*d* has a flat holding surface 239*d* to support the second ball bearing 520 thereon.

Figure 9:
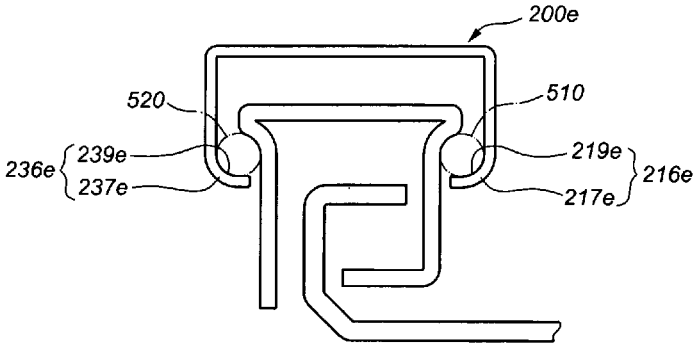
FIG. 9 is a cross-sectional view showing a fifth different type of the second rail member according to the preferred embodiment of the present invention.

FIG. 9 shows a fifth different type of the second rail member according to the preferred embodiment of the present invention. A first holding portion 216*e* of a second rail member 200*e* comprises a first supporting segment 217*e*. The first supporting segment 217*e* has a curved holding surface 219*e* to support the first ball bearing 510 thereon. A second holding portion 236*e* of the second rail member 200*e* comprises a first supporting segment 237*e*. The first supporting segment 237*e* has a curved holding surface 239*e* to support the second ball bearing 520 thereon.

Figure 10:
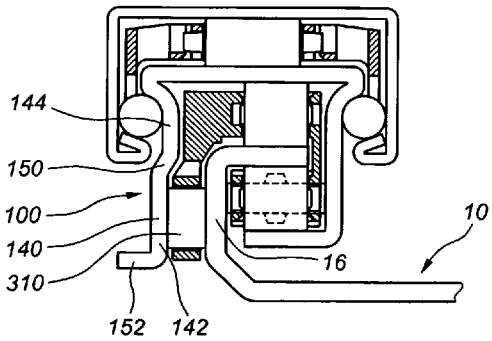
FIG. 10 is a cross-sectional view showing a different type of the first rail member according to the preferred embodiment of the present invention.

FIG. 10 shows a different type of the first rail member according to the preferred embodiment of the present invention. The second vertical portion 140 of the first rail member 100 has a first bent portion 150 extending from the second end 144 of the second vertical portion 140 of the first rail member 100 to change the distance between the second vertical portion 140 of the first rail member 100 and the first vertical portion 16 of the bracket 10 for corresponding to the size of the first roller bearing 310 to seat therein. The second vertical portion 140 of the first rail member 100 further has a second bent portion 152 extending from the first end 142 of the second vertical portion 140 of the first rail member 100 to enhance the strength of the first rail member 100.

What is claimed is:

1. A slide assembly, comprising:

a bracket comprising a first horizontal portion, a first vertical portion, and a second horizontal portion, the first horizontal portion having a first end, the first vertical portion having a first end and a second end extending from the first end of the first horizontal portion, the second horizontal portion having a first end and a second end extending from the first end of the first vertical portion;

a first rail member slidably disposed on the bracket, the first rail member comprising a first horizontal portion, a first vertical portion, a second horizontal portion, and a second vertical portion, the first horizontal portion having a first end, the first vertical portion having a first end and a second end extending from the first end of the first horizontal portion, the second horizontal portion having a first end and a second end extending from the first end of the first vertical portion, the second vertical portion having a first end and a second end extending from the first end of the second horizontal portion;

a second rail member slidably disposed on the first rail member, the second rail member comprising a first vertical portion, a first horizontal portion, and a second vertical portion, the first vertical portion having a first end and a second end, the first horizontal portion having a first end and a second end extending from the first end of the first vertical portion, the second vertical portion having a first end and a second end extending from the first end of the first horizontal portion;

a first auxiliary sliding member disposed between the bracket and the first rail member, the first auxiliary sliding member comprising a first seat, at least one first roller bearing, at least one second roller bearing, at least one third roller bearing, and at least one fourth roller bearing, the first roller bearing being disposed between the first vertical portion of the bracket and the second vertical portion of the first rail member for providing a rolling contact, the second roller bearing being disposed between the first vertical portion of the bracket and the first vertical portion of the first rail member for providing the rolling contact, the third roller bearing being disposed between the first horizontal portion of the bracket and the second horizontal portion of the first rail member for providing the rolling contact, the fourth roller bearing being disposed between the first horizontal portion of the bracket and the first horizontal portion of the first rail member for providing the rolling contact;

a second auxiliary sliding member disposed between the first rail member and the second rail member, the second auxiliary sliding member comprising a first seat and at least one first roller bearing, the first roller bearing being disposed between the second horizontal portion of the first rail member and the first horizontal portion of the second rail member for providing the rolling contact; and a plurality of ball bearings including at least one first ball bearing and at least one second ball bearing, the first ball bearing being disposed between the first vertical portion of the first rail member and the first vertical portion of the second rail member for providing a free rolling direction contact, the second ball bearing being disposed between the second vertical portion of the first rail member and the second vertical portion of the second rail member for providing the free rolling direction contact; said first horizontal portion of said bracket is captured between said third roller bearing and said fourth roller bearing, said third and fourth roller bearings contiguously contacting opposing surfaces of said first horizontal portion of said bracket;

wherein a first bearing raceway is formed between the first vertical portion of the first rail member and the first vertical portion of the second rail member for the first roller bearing to seat and to slide therealong; wherein the first bearing raceway is formed between a first contact surface provided at the first end of the first vertical portion of the first rail member in relation to the first ball bearing and a first holding portion provided at the second end of the first vertical portion of the second rail member in relation to the first ball bearing, the first holding portion extending from the second end of the first vertical portion of the second rail member, wherein the first holding portion comprises a first supporting segment and a second supporting segment extending and bending from the first supporting segment in the shape of a folded bead, the second supporting segment or the first supporting segment having a holding surface to support the first ball bearing;

wherein a second bearing raceway is formed between the second vertical portion of the first rail member and the second vertical portion of the second rail member for the second roller bearing to seat and to slide therealong; wherein the second bearing raceway is formed between a second contact surface provided at the second end of the second vertical portion of the first rail member in relation to the second ball bearing and a second holding portion provided at the first end of the second vertical portion of the second rail member in relation to the second ball bearing, the second holding portion extending from the first end of the second vertical portion of the second rail member; wherein the second holding portion comprises a first supporting segment and a second supporting segment extending and bending from the first supporting segment in the shape of a folded bead, the second supporting segment or the first supporting segment having a holding surface to support the second ball bearing.

2. The slide assembly as claimed in claim 1, wherein the first seat of the second auxiliary member is provided with a plurality of holding members relative to the ball bearings for holding the ball bearings in a preset position.

3. The slide assembly as claimed in claim 1, wherein the first seat of the second auxiliary member is provided with a buffer for easing striking force during operation.

4. The slide assembly as claimed in claim 2, wherein the plurality of holding members includes a first holding member and a second holding member, at least one of the plurality of ball bearings being disposed between the first holding member and the second holding member, a first width being defined between relative inner sides of the first holding member and the second holding member, the inner sides of the first holding member and the second holding member being formed with a bearing groove, respectively, in relation to the ball bearing, a second width being defined between the bearing groove of the first holding member and the bearing groove of the second holding member, a third width being defined between the bearing groove of the first holding member and the inner side of the second holding member, the ball bearing having a diameter larger than the first width but smaller than the second and third width.

5. The slide assembly as claimed in claim 3, wherein the buffer is in the form of a closed ring.

6. The slide assembly as claimed in claim 1, wherein the second vertical portion of the first rail member has a first bent portion extending from the second end of the second vertical portion of the first rail member to accommodate the first roller bearing between the second vertical portion of the first rail member and the first vertical portion of the bracket.

7. The slide assembly as claimed in claim 6, wherein the second vertical portion of the first rail member has a second bent portion extending from the first end of the second vertical portion of the first rail member.

* * * * *